US005900342A

United States Patent [19]

Visser et al.

[11] Patent Number: 5,900,342

[45] Date of Patent: May 4, 1999

[54] PHOTOCONDUCTIVE ELEMENT HAVING AN OUTERMOST LAYER OF A FLUORINATED DIAMOND-LIKE CARBON AND METHOD OF MAKING THE SAME

[75] Inventors: Susan A. Visser, Rochester; Paul M. Borsenberger, Hilton, both of N.Y.

[73] Assignee: Eastman Kodak Company, Rochester, N.Y.

[21] Appl. No.: 08/639,374

[22] Filed: Apr. 26, 1996

[51] Int. Cl.[6] ..... G03G 5/047; G03G 5/147

[52] U.S. Cl. ..... 430/59; 430/66; 430/67; 430/128; 430/132

[58] Field of Search ..... 430/59, 66, 67, 430/128, 132

[56] References Cited

U.S. PATENT DOCUMENTS

| | | | |
|---|---|---|---|
| 3,615,414 | 10/1971 | Light | 96/1.6 |
| 4,082,551 | 4/1978 | Steklenski et al. | 96/1 PC |
| 4,127,412 | 11/1978 | Rule et al. | 96/1 PC |
| 4,175,960 | 11/1979 | Berwick et al. | 430/58 |
| 4,495,263 | 1/1985 | VanderValk | 430/60 |
| 4,529,678 | 7/1985 | Ohta | 430/58 |
| 4,629,671 | 12/1986 | Everhardus et al. | 430/59 |
| 4,666,802 | 5/1987 | Hung et al. | 430/58 |
| 4,668,600 | 5/1987 | Lingnau | 430/83 |
| 4,675,265 | 6/1987 | Kazama et al. | 430/67 |
| 4,677,045 | 6/1987 | Champ et al. | 430/76 |
| 4,701,396 | 10/1987 | Hung et al. | 430/58 |
| 4,873,165 | 10/1989 | Karakida et al. | 430/66 |
| 4,882,256 | 11/1989 | Osawa et al. | 430/66 |
| 4,886,722 | 12/1989 | Law et al. | 430/59 |
| 4,895,782 | 1/1990 | Koyama et al. | 430/58 |
| 4,927,726 | 5/1990 | Scozzafava et al. | 430/78 |
| 4,932,859 | 6/1990 | Yagi et al. | 430/66 |
| 4,952,471 | 8/1990 | Baranyi et al. | 430/59 |
| 4,957,838 | 9/1990 | Aruga et al. | 430/59 |
| 4,965,156 | 10/1990 | Hotomi et al. | 430/66 |
| 4,971,873 | 11/1990 | Pavlisko et al. | 430/58 |
| 4,981,767 | 1/1991 | Tokura et al. | 430/58 |
| 4,987,004 | 1/1991 | Yamazaki et al. | 427/38 |
| 5,037,575 | 8/1991 | Miura et al. | 252/299 |
| 5,059,502 | 10/1991 | Kojima et al. | 430/66 |
| 5,102,758 | 4/1992 | Kazmaier et al. | 430/58 |
| 5,112,935 | 5/1992 | Yacobucci et al. | 528/176 |
| 5,135,828 | 8/1992 | Yang et al. | 430/59 |
| 5,139,911 | 8/1992 | Yagi et al . | 430/66 |
| 5,168,023 | 12/1992 | Mitani et al. | 430/58 |
| 5,168,025 | 12/1992 | Ono et al. | 430/59 |
| 5,190,840 | 3/1993 | Weiss | 430/96 |
| 5,202,207 | 4/1993 | Kanemaru et al. | 430/59 |
| 5,221,591 | 6/1993 | Bugner et al. | 430/58 |
| 5,238,764 | 8/1993 | Molaire et al. | 430/58 |
| 5,240,801 | 8/1993 | Hayashi et al. | 430/57 |
| 5,242,775 | 9/1993 | Yamazaki | 430/66 |
| 5,244,767 | 9/1993 | Bugner et al. | 430/126 |
| 5,256,483 | 10/1993 | Yamazaki et al. | 428/408 |
| 5,256,509 | 10/1993 | Hayashi et al. | 430/66 |
| 5,262,262 | 11/1993 | Yagi et al. | 430/66 |
| 5,288,573 | 2/1994 | Hung et al. | 430/58 |
| 5,312,707 | 5/1994 | Ota et al. | 430/59 |
| 5,324,605 | 6/1994 | Ono et al. | 430/59 |
| 5,330,865 | 7/1994 | Leus et al. | 430/59 |
| 5,332,635 | 7/1994 | Tanaka | 430/96 |
| 5,334,856 | 8/1994 | Otsuka et al. | 257/40 |
| 5,338,633 | 8/1994 | Nozomi et al. | 430/59 |
| 5,411,828 | 5/1995 | Kashizaki | 430/58 |
| 5,525,447 | 6/1996 | Ikuno et al. | 430/67 |

OTHER PUBLICATIONS

Weiss et al, Analysis of Electrostatic Latent Image Blurring Caused by Photoreceptor Surface Treatments, Proc. IS& T 11th Intern. Cong. on Adv Non–impact Printing Tech. pp. 57–59 (1995).

F.M. Fowkes, ed. Contact Angle, Wettability and Adhesion, Adv in Chem. Ser., 43, Amer. Chem. Soc., Washington, DC (1964) p. 21.

U.S. Application Serial No. 08/584,502 to Borsenberger et al. Filed Jan. 11, 1996.

Liston et al, "Plasma Surface Modification of Polymers for Improved Adhesion: A Critical Review," *J. Adhesion Sci. Technol.l*, vol. 7(10)(1993) pp. 1091–1127.

Borsenberger and Weiss, Organic Photoreceptors for Imaging Systems, Chp. 11, VI. *Squaraine Pigments*,pp.368–380, published in 1993 by Marcel Dekker, Inc., New York, NY.

Derwent Abstract Acc No. 89–029712/04 of JP 63–305365 (Pub Dec. 1988).

Derwent Abstract Acc No. 87–209435/30 of JP 62–135839 (Pub Jun. 1987).

Derwent Abstract Acc No. 90–315647/42 of JP 2222963 (Pub Sep. 1990).

Derwent Abstract Acc No. 85–319556/51 of JP 60–221766 ( Pub Nov. 1985).

D'Agostino, Favia & Fracassi, The Effect of Power on the Plasma–Assisted Deposition of Fluorinated Monomers, 1990, Journal of Polymer Science Part A: Polymer Chemistry, vol. 28, pp. 3387–3402.

Pavlath & Pittman, Plasma Deposition of Fluorinated Compounds, 1979, The American Chemical Society, pp. 181–191.

O'Keefe & Rigsbee, Plasma Polymerization of Fluorocarbon Thin Films on Glass and Metal Substrates, 1993, Mat. Res. Soc. Symp. Proc., vol. 304, pp. 179–184.

D.K. Owens et al, Estimation of the Surface Free Energy of Polymers, 1969, Journal of Applied Polymer Science, vol. 13, pp. 1741–1747.

*Primary Examiner*—Janis L. Dote
*Attorney, Agent, or Firm*—Doreen M. Wells

[57] ABSTRACT

There is provided an electrophotographic element and method of making the electrophotographic element comprising a conductive support, a charge generation layer and a charge transport layer, said electrophotographic element having thereon a protective layer of a fluorinated diamond-like carbon wherein the fluorine content of the outermost surface of the fluorinated diamond-like carbon layer is between about 25 and about 65 atomic percent based on the total composition of the outermost surface of the protective layer. The protective layer provides for a low surface energy coating having a long process lifetime without causing latent image spread or degradation of photosensitivity.

20 Claims, No Drawings

PHOTOCONDUCTIVE ELEMENT HAVING AN OUTERMOST LAYER OF A FLUORINATED DIAMOND-LIKE CARBON AND METHOD OF MAKING THE SAME

FIELD OF THE INVENTION

The invention relates to electrophotographic elements. More particularly, it relates to photoconductive elements and methods of making photoconductive elements having a low surface energy protective layer that extends the usable photoconductive element lifetime.

BACKGROUND OF THE INVENTION

Electrophotographic imaging processes and techniques have been extensively described in patents and other literature. Generally, these processes have in common the steps of employing a photoconductive insulating element which is prepared to respond to imagewise exposure with electromagnetic radiation by forming a latent electrostatic charge image. A variety of subsequent operations, well-known in the art, can then be employed to produce a visible record of the electrostatic image.

A group of important electrophotographic elements used in these electrophotographic imaging processes comprise a conductive support in electrical contact with a charge generation layer (CGL) and a charge transport layer (CTL). Electrophotographic elements having at least one of the layers designed primarily for the photogeneration of charge carriers (holes and electrons), referred to as CGL, and at least one other layer designed primarily for the transport of the generated charge carriers, referred to as CTL, are sometimes referred to as multilayer or multiactive electrophotographic elements. Representative patent publications disclosing methods and materials for making and using such elements include U.S. Pat. Nos. 4,495,263; 4,701,396; 4,666,802; 4,427,139; 3,615,414; 4,175,960 and 4,082,551.

Photoconductive elements of this type have found widespread use in xerography. One continuing problem is that the lifetime of these elements is less than desired. The photoconductive elements are cycled in the machine and go through all of the steps in the electrophotographic imaging process many times. The corona charging and cleaning steps in the process are particularly damaging to the photoconductive element. It is believed that corona charging causes the formation of chemical species on the photoconductive element surface which causes a problem called "image spread". In Order to overcome this problem, the cleaning step is designed to remove these species. While removing these species, the cleaning step also removes a surface layer of the photoconductive element. Thus, a small amount of photoconductive element is removed with each cycle. Eventually, the photoconductor will be worn to the point of needing replacement.

Further, organic photoconductive elements are scratch prone. Extreme care must be taken when installing replacement elements since any scratches show up as defects on copies.

It has been proposed to put protective overcoats on photoconductive elements of this general type. For example, U.S. Pat. No. 4,965,156 to Hotomi et al. discloses the use of two protective layers on an organic photoconductive element. The first layer is an amorphous carbon layer which includes more than 5 atomic percent fluorine. The second, outermost layer is a similar material except that the fluorine content must be lower than 5 atomic percent. Hotomi et al. teach that if the fluorine content is above 5 atomic percent in the outermost layer, it causes image fogging. The photoconductor of interest to Hotomi et al. includes a hydrazone compound in the charge transport layer.

Arylamines used as charge transport materials in photoconductive elements are described in U.S. Pat. Nos. 4,127,412 and 5,190,840 and are used commercially.

One potentially useful protective coating for electrophotographic elements would be a diamond-like carbon coating; however, such coatings, while providing for physical protection from scratches, also have high surface energies. High surface energies make the removal of toner from the photoconductive element difficult and decrease the efficiency of processes involved in the removal of toner from the photoconductive member, such as cleaning, resulting in image defects and in the transfer of unwanted toner to subsequent copies, reducing copy quality. It is not apparent what modification can be made to such coatings to reduce or eliminate this problem.

Accordingly, there is a continuing need for photoconductive elements of this type which have longer process lifetimes and low surface energy.

SUMMARY OF THE INVENTION

In accordance with the present invention, there is provided an electrophotographic element comprising a conductive support, a charge generation layer, a charge transport layer comprising an arylamine, and a diamond-like carbon (DLC) layer having an outermost surface, wherein the fluorine content of said outermost surface of the said diamond-like carbon layer is between 25 and 65 atomic percent, preferably between 30 and 65 atomic percent based on the total composition of said outermost surface of said diamond-like carbon (DLC) layer.

Further there is provided the method of making an electrophotographic element comprising a conductive support, a charge generation layer, a charge transport layer comprising an arylamine, and a diamond-like carbon (DLC) layer having an outermost surface, wherein the fluorine content of said outermost surface of said diamond-like carbon (DLC) layer is between 25 and 65 atomic percent based on the total composition of said outermost surface of said diamond-like carbon layer, said method comprising the step of plasma-enhanced chemical vapor depositing a feed gas comprising a gas or gaseous form of a fluorocarbon compound.

The electrophotographic element of the invention includes a protective layer which is a DLC layer having a high amount of fluorine in the outermost surface. Unlike the photoconductive composition of Hotomi et al., this high level of fluorine in the outermost layer does not cause fogging, referred to herein as latent image spread (LIS), with the photoconductive compositions used in the present invention. Further, the presence of fluorine at the specified amount provides a protective coating having a low surface energy.

DETAILS OF THE INVENTION

The electrophotographic element of this invention comprising a CTL, CGL and diamond-like carbon (DLC) layer is useful as a photoconductive element, also referred to herein as a photoconductor, in electrophotographic apparatus, such as, copiers or printers.

The diamond-like carbon layer, particularly a fluorinated diamond-like carbon, which is also referred to as plasma-polymerized fluorocarbon film. The fluorinated diamond-like carbon is preferably formed by plasma-enhanced chemical vapor deposition (PE-CVD), also known as glow-discharge decomposition, using an alternating current (AC) or direct current (DC) power source. The AC supply may operate in the radio frequency or the microwave range. Selection of PE-CVD processing parameters, such as power source type or frequency, system pressure, feed gas flow rates, inert diluent gas addition, substrate temperature, and reactor configuration, to optimize product properties is well known in the art. The diamond-like carbon layer may comprise a single layer having a uniform composition or one or more multiple layers of non-uniform compositions; however, it is preferred that the diamond-like carbon layer is a single layer of fluorinated diamond-like carbon, preferably having a uniform composition. Further, the a diamond-like carbon layer can be formed by a single or multiple passes through, for example, the PE-CVD apparatus or reactor; however, it is preferred that the DLC layer is formed by a single pass through the PE-CVD apparatus or reactor. PE-CVD reactors are commercially available from, for example, PlasmaTherm, Inc.

The fluorine content of the outermost surface of the DLC layer, that is, the surface that comes into contact with the toner, can be between 25 and 65 atomic percent, preferably between 30 and 65 atomic percent, based on the total atomic composition of the outermost surface of the DLC layer. The outermost surface of the DLC can also have at least about 10%, preferably at least 15%, most preferably at least 30%, of the carbon bonded to two or more fluorine atoms ($CF_2$ or $CF_3$), and at least about 2.5%, but not more than 70%, of the carbon bonded to three fluorine atoms ($CF_3$). Polymers formed using plasma-assisted methods tend to be highly crosslinked films that do not exhibit long range order or a characteristic repeat unit like conventional polymers.

As noted, the atomic percent of fluorine in the outermost surface of the DLC layer can be between about 25 and about 65 atomic percent. The atomic percent of the outermost surface of the layer can be determined using X-Ray Photoelectron Spectroscopy (XPS). This is a well known technique that analyzes just the outermost surface of a material. For the purposes of the present invention, the term "outermost surface" corresponds to an analysis depth of any thickness of the DLC layer, preferably 5 nanometers (nm), if the DLC layer has a uniform composition, or less than 1 nm if the DLC has a nonuniform composition. A typical measurement is described in detail in Example 1.

The protective layer, that is the DLC layer, on the photoconductive element preferably has a surface energy of less than 40 mN/m, more preferably less than 35 mN/m, most preferably less than 25 mN/m. Surface energies greater than 50 mN/m typically exhibit problems with removal of toner from the photoconductive element. Lower surface energies are desired.

The feed gases selected for preparing the fluorocarbon coating influence the composition and properties of the coating. See for example, M. J. O'Keefe and J. M. Rigsbee, *Mat. Res. Soc. Symp. Proc.* 304, 179 (1993); A. E. Pavlath and A. G. Pittman,*ACS Symp. Ser.* 108 (*Plasma Polym.*), 181–192 (1979); R. d'Agostino, P. Favia, and F. Fracassi, *J. Polym. Sci.* A 28, 3387 (1990); and R. d'Agostino, F. Cramarossa, and S. DeBenedictis, *Plasma Chem. and Plasm Process.* 4, 417 (1982).

Feed gases used to prepare the plasma-polymerized fluorocarbon coatings, that is, DLC layer, used in this invention must include sources of fluorine and carbon. Fluorocarbon compounds include but are not limited to paraffinic fluorocarbons represented by the formula $C_nF_xH_y$, where n is 1 to 10, preferably 2 to 4, x+y=2n+2, and x is 3 to 2n+2, preferably 2n+2; olefinic fluorocarbons represented by the formula $C_nF_xH_y$, where n is 2 to 10, preferably 2 to 4, x+y=2n, and x is 2 to 2n, preferably 2n; acetylenic fluorocarbons represented by $C_nF_xH_y$, where n is 2 to 10 preferably 2, x+y=2n−2, and x is 1 to 2n−2, preferably 2n−2; alkyl metal fluorides; aryl fluorides having from 6 to 14 carbon atoms; alicyclic fluorides, preferably perfluorinated alicyclic compounds, having from 3 to 8 carbon atoms, preferably from 3 to 6 carbon atoms; styrene fluorides; fluorine-substituted silanes; fluorinated ketones; fluorinated aldehydes; and organic substituted compounds thereof. These fluorocarbon feed compounds may have a branched structure. Examples include hexafluoroethane; tetrafluoroethylene; pentafluoroethane; octafluoropropane; 2H-heptafluoropropane; 1H-heptafluoropropane; hexafluoropropylene; 1,1,1,3,3,3-hexafluoropropane; 1,1,1,2,2,3-hexafluoropropane; 1,1,1,2,3,3-hexafluoropropane; 2-(trifluoromethyl)-1,1,1,3,3,3-hexafluoropropane; 3,3,3-trifluoropropyne; 1,1,1,3,3-pentafluoropropane; 1,1,1,3,3-pentafluoropropene; 1,1,1,2,2-pentafluoropropane; 3,3,3-trifluoropropyne; decafluorobutane; octafluorobutene; hexafluoro-2-butyne; 1,1,1,4,4,4-hexafluorobutane; 1,1,1,4,4,4-hexafluoro-2-butene; perfluoro(t-butyl)acetylene; dodecafluoropentane; decafluoropentene; 3,3,4,4,4-pentafluorobutene-1; perfluoroheptane; perfluoroheptene; perfluorohexane; 1H,1H,2H-perfluorohexene; perfluoro-2,3,5-trimethyl-hexene-2; perfluoro-2,3,5-trimethylhexene-3; perfluoro-2,4,5-trimethylhexene-2; 3,3,4,4,5,5,5-heptafluoro-1-pentene; decafluoropentene; perfluoro-2-methylpentane; perfluoro-2-methyl-2-pentene, perfluoro-4-methyl-2-pentene, hexafluoroacetone, perfluorobenzene, perfluorotoluene, perfluorostyrene, hexafluorosilane, dimethylaluminum fluoride, trimethyltin fluoride, and diethyltin difluoride. The fluorocarbon compounds need not always be in a gaseous phase at room temperature and atmospheric pressure, but can be in a liquid or solid phase insofar as they can be vaporized on melting, evaporation, or sublimation, for example, by heating or in a vacuum, in order to yield a gaseous form of the fluorocarbon compound.

Sources of carbon include the fluorocarbons listed above and hydrocarbon compounds. The hydrocarbon compounds include paraffinic hydrocarbons represented by the formula $C_nH_{2n+2}$, where n is 1 to 10, preferably 1 to 4; olefinic hydrocarbons represented by formula $C_nH_{2n}$, where n is 2 to 10, preferably from 2 to 4; acetylenic hydrocarbons represented by $C_nH_{2n-2}$, where n is 2 to 10, preferably 2; alicyclic hydrocarbons; aromatic compounds; and organic substituted compounds thereof. This list includes, but is not limited to, the following: methane, ethane, propane, butane, pentane, hexane, heptane, octane, isobutane, isopentane, neopentane, isohexane, neohexane, dimethylbutane, methylhexane, ethylpentane, dimethylpentane, tributane, methylheptane, dimethylhexane, trimethylpentane, isononane and the like; ethylene, propylene, isobutylene, butene, pentene, methylbutene, heptene, tetramethylethylene, hexene, octene, allene, methyl-allene, butadiene, pentadiene, hexadiene, cyclopentadiene, ocimene, alloocimene, myrcene, hexatriene, acetylene, allylene, diacetylene, methylacetylene, butyne, pentyne, hexyne, heptyne, octyne, and the like; cyclopropane, cyclobutane, cyclopentane, cyclohexane, cycloheptane, cyclooctane, cyclopropene, cyclobutene, cyclopentene, cyclohexene, cycloheptene, cyclooctene, limonene, terpinolene, phellandrene, sylvestrene, thujene, carene, pinene, bornylene, camphene, tricyclene, bisabolene, zingiberene, curcumene, humalene, cadinenesesquibenihene, selinene, caryophyllene, santalene, cedrene, camphorene, phyllocladene, podocarprene, mirene, and the like; benzene, toluene, xylene, hemimellitene, pseudocumene, mesitylene, prehnitene, isodurene, durene, pentamethyl-benzene, hexamethylbenzene, ethylbenzene, propylbenzene, cumene, styrene, biphenyl, terphenyl, diphenylmethane, triphenylmethane, dibenzyl, stilbene, indene, naphthalene, tetralin, anthracene, phenanthrene, and the like. The hydrocarbon compounds need not always be in a gaseous phase at room temperature and atmospheric pressure, but can be in a liquid or solid phase insofar as they can be vaporized on melting, evaporation, or sublimation, for example, by heating or in a vacuum, in order to yield a gaseous form of the hydrocarbon compound.

Paraffinic, fully fluorinated fluorocarbons and mixtures thereof are preferred. Olefinic or acetylinic hydrocarbons or mixtures thereof are preferred. Hydrogen is usually incorporated into the films in the form of the hydrogen present in the hydrocarbon feed gas. Pure hydrogen may also be used as an additional feed gas. Mixtures of two or more types of hydrocarbons can be used with one or more fluorocarbon compounds. Mixtures of one or more fluorocarbons, one or more hydrocarbons, and hydrogen can be used.

The presence of hydrogen is not required but may be included at levels up to 25 atomic % without loss of desirable properties. Oxygen may also be incorporated into the films from the feed gas or from atmospheric oxygen gained through reaction with free radicals present on the substrate as it is removed from the reactor. Oxygen should constitute no more than 20 atomic %, preferably less than 10 atomic %, of the surface composition of the layer.

Inert gases such as argon, helium, neon, xeon, or the like optionally may be fed into the reactor during the deposition of the fluorinated DLC layers in order to control the properties of the coating. The use of inert gases to control coating properties is well known to those skilled in the art.

The thickness of the fluorinated DLC layer is preferably between about 0.05 and 0.5 micrometers, more preferably between about 0.15 and 0.2 micrometers. Thinner coatings tend not to form continuous films. Thicker coatings tend to contain high stress that results in spontaneous delamination of the DLC layer from the photoconductor.

The charge transport layer comprises at least one arylamine as the charge transport material. The charge transport layer can transport either or both types of charge carriers, that is, holes and electrons; however, it is preferred that the arylamine charge transport material is a p-type transport material, that is, it transports holes. Examples of aylamines that can be used in the charge transport layer of the photoconductive elements or methods of this invention include triphenylamine; tri-p-tolylamine; N-N'diphenyl-N,N'-bis(3-methylphenyl)-(1,1'-biphenyl)-4,4'diamine; 1,1-bis(di-4-tolylaminophenyl)cyclohexane; N,N',N",N'"-tetrakis(4-methylphenyl)-(1,1'-biphenyl)-4,4'-diamine; 4-(4-methoxystyryl)-4',4"-dimethoxytriphenylamine; N,N'-diphenyl-N,N'-di(m-tolyl)-p-benzidine; and mixtures of two or more of these charge transport materials. These and other useful arylamines are disclosed in U.S. Pat. Nos. 4,127,412; 4,957,838; 5,190,840; 5,112,935; 5,135,828; 5,168,025; 5,312,707; 5,332,635; 5,324,605; 5,338,633; and 5,202,207, incorporated herein by reference. The preferred arylamines are tri-p-tolylamine; and 1,1-bis(di-4-tolylaminophenyl) cyclohexane, and mixtures of these two materials.

In addition to the arylamine, the CTL may comprise one or more binder materials and/or one or more additional charge transport materials. The binder and the additional charge transport materials can be one material or two or more different materials. The preferred CTL comprises one or more arylamine transport materials and a polyester binder.

The polyester binders can be prepared using well known solution polymerization techniques such as disclosed in W. Sorenson and T. Campbell, Preparative Methods of Polymer Chemistry, page 137, Interscience (1968). Schotten-Baumann conditions were employed to prepare the following examples of useful polyester binders: poly{4,4'-isopropylidene bisphenylene terephthalate-co-azelate (70/30)}; poly{4,4'-isopropylidene bisphenylene terephthalate-co-isophthalate-co-azelate (50/25/25)}; poly{4,4'-isopropylidene bisphenylene-co-4,4'-hexafluoroisopropylidene bisphenylene (75/25) terephthalate-co-azelate (65/35)}; poly{4,4'-isopropylidene bisphenylene-co-4,4'-hexafluroisopropylidene bisphenylene (50/50) terephthalate-co-azelate (65/35)}; poly{4,4'-hexafluoroisopropylidene bisphenylene terephthalate-co-azelate (65/35)}; poly{hexafluoroisopropylidene bisphenylene terephthalate-co-isophthalate-co-azelate (50/25/25)}; and poly{4,4'-isopropylidene bisphenylene isophthalate-co-azelate (50/50)}.

The thickness of the CTL may vary. It is especially advantageous to use a charge transport layer which is thicker than that of the charge generation layer, with best results generally being obtained when the charge transport layer is from about 2 to about 200 times, preferably 10 to 40 times, as thick as the charge generation layer. A useful thickness for the charge generation layer is within the range of from about 0.1 to about 15 microns dry thickness, particularly from about 0.5 to about 6 microns.

The CGL comprises a charge generation material. The charge generation material can comprise one or more dye polymer aggregates, phthalocyanines, squaraines, perylenes, azo-compounds and trigonal selenium particles. The CGL may comprise a binder; however, certain charge generation materials without a binder may be vacuum deposited to form a CGL. Examples of charge generation materials, useful binders and methods of preparing the CGL are disclosed in U.S. Pat. Nos. 4,529,678; 4,701,396; 4,666,802; 4,427,139; 4,668,600; 4,971,873; 4,629,671; 4,677,045; 4,886,722; 4,952,471; 4,895,782; 4,981,767; 4,927,726; 5,102,758; 5,244,767; 5,238,764; 5,221,591; 5,288,573; 5,037,575; 5,330,865; 5,334,856; and 5,411,828, incorporated herein by reference. Additional charge generation materials and various sensitizing materials, such as spectral sensitizing dyes and chemical sensitizers may also be incorporated in the charge generation layer.

The CGL preferably comprises dye polymer aggregate charge generation material dispersed in an insulating polymeric binder. Examples of useful dye polymer aggregates for use in the charge generation layer are disclosed in U.S. Pat. Nos. 4,175,960; and 3,615,414, incorporated herein by reference.

Useful binders in the CGL are known to a person of ordinary skill in the art. The preferred binders are polycarbonates, for example Lexan™ available from GE and Makrolon™ available from Mobay, Inc.

Charge generation layers and charge transport layers in elements of the invention can optionally contain other addenda such as leveling agents, surfactants, plasticizers, sensitizers, contrast control agents, and release agents, as is well known in the art.

The multilayer photoconductive elements of the invention can be affixed, if desired, directly to an electrically conducting substrate. Either the charge generation layer or the charge transport layer may be closer to or in contact with the DLC layer. In some cases, it may be desirable to use one or more intermediate subbing layers or additional charge transport layers between the conductive support and the CTL or CGL, or between the CTL and CGL to improve adhesion between the CTL, CGL and conductive support and/or to act as an electrical barrier layer between the multi-active element and the conducting substrate.

Electrically conductive supports include, for example, paper (at a relative humidity above 20 percent); aluminum-paper laminates; metal foils such as aluminum foil, zinc foil, etc.; metal plates, such as aluminum, copper, zinc, brass and galvanized plates; vapor deposited metal layers such as silver, chromium, nickel, aluminum and the like coated on paper or conventional photographic film supports, such as cellulose acetate, polystyrene, poly(ethylene terephthalate), etc. Such conductive materials as chromium, nickel, etc., can be vacuum deposited on transparent film supports in sufficiently thin layers to allow electrophotographic elements prepared therewith to be exposed from either side of such elements.

To prepare the electrophotographic elements of the invention, the components of the charge generation layer, or the components of the charge transport layer, including binder and any desired addenda, are dissolved or dispersed together in an organic solvent to form a coating composition which is then solvent coated over an appropriate conductive support. The liquid is then allowed or caused to evaporate from the mixture to form the charge generation layer or charge transport layer.

Suitable organic solvents include aromatic hydrocarbons such as benzene, toluene, xylene and mesitylene; ketones such as acetone, butanone and 4-methyl-2-pentanone; halogenated hydrocarbons such as dichloromethane, 1,1,2-trichloroethane, chloroform and ethylene chloride; ethers including ethyl ether and cyclic ethers such as dioxane and tetrahydrofuran; other solvents such as acetonitrile and dimethylsulfoxide; and mixtures of such solvents. The amount of solvent used in forming the binder solution is typically in the range of from about 2 to about 100 parts of solvent per part of binder by weight, and preferably in the range of from about 10 to 50 parts of solvent per part of binder by weight.

In the preferred coating compositions, the optimum ratios of both charge generation material and charge transport material to binder can vary widely, depending on the particular materials employed. In general, useful results are obtained when the total concentration of both charge generation material and charge transport material in the layers is within the range of from about 0.01 to about 90 weight percent based on the dry weight of the layers. In a preferred embodiment of a multiple layer electrophotographic element of the invention, the coating composition contains from about 0 to about 40 weight percent of charge transport material and from 0.01 to about 80 weight percent of charge generation material based on the weight of the layer.

The initial image forming step in electrophotography is the creation of an electrostatic latent image on the surface of a photoconductive element. This can be accomplished by charging the element in the dark to a positive or negative potential of several hundreds volts by either a corona or roller charging device, then exposing the photoconductive element to an imagewise pattern of radiation that corresponds to the image that is to be produced. Absorption of the image exposure creates free electron-hole pairs. Under the influence of the electric field depending upon the configuration of the CTL and CGL, the holes migrate toward the conductive support, and the electrons migrate toward the surface of the photoconductive element, or the electrons migrate toward the conductive support and the holes migrate toward the surface of the photoconductive element. In such a manner, the surface charge is dissipated in the exposed regions, thus creating an electrostatic charge pattern. Electrophotographic toner can then be deposited onto the electrostatic charge pattern. The resulting image can be transferred to a receiver such as uncoated or coated paper, plastic, or transparency material and rendered permanent with an appropriate fusing or fixing process.

The following examples are presented for a further understanding of the invention.

Photoconductive Element A

Photoconductive Element A was a negatively charging, multi-active photoconductive element not having a DLC layer and was prepared as follows. First, the CGL was coated onto a 7 mil thick nickelized poly(ethylene terephthalate) support at a dry coverage of 6.57 g/m$^2$ (0.61 g/ft$^2$). The CGL coating mixture comprised 49.5 wt % polycarbonate (Lexanm available from GE), 2.5 wt % [poly(ethylene-co-2,2-dimethylpropylene terphthalate)], 39.25 wt % 1,1-bis-[4-(di-4-tolylamino)phenyl] cyclohexane, 0.75 wt % diphenylbis-(4-diethylaminophenyl)methane, 6.4 wt % 4-(4-dimethylaminophenyl)-2,6-diphenylthiapyrylium hexafluorophosphate, 1.6 wt % 4-(4-dimethylaminophenyl)-2-(4-ethoxyphenyl)-6-phenylthiapyryliumm flouoroborate, and 2.4 wt % of the aggregate "seed" (a dried paste of the above CGL mixture which had been previously prepared). The CGL mixture was prepared at 9 wt % in an 80/20 (wt/wt) mixture of dichloromethane and 1,1,2-trichloroethane. A coating surfactant, DC510 (Dow Corning Corporation), was added at a concentration of 0.01 wt % of the total CGL mixture.

The CTL having a p-type charge transport material was coated onto the CGL at a dry coverage of 13.72 g/m$^2$ (1.275 g/ft$^2$). The CTL mixture comprised 60 wt % poly[4,4'-(2-norbornylidene)bisphenol terephthalate-co-azelate-(60/40)], 19.75 wt % 1,1-bis-[4-(di-4-tolylamino)phenyl] cyclohexane, 19.5 wt % tri-(4-tolyl)amine, and 0.75 wt % diphenylbis-(4-diethylaminophenyl)methane. The CTL mixture was prepared at 10 wt % in a 70/30 (wt/wt) mixture of dichloromethane and methyl acetate. A coating surfactant, DC510, was added at a concentration of 0.024 wt % of the total CTL mixture. After the CGL and CTL layers had dried the photoconductive element was cut into 5 cm by 5 cm samples which were used in several of the Examples below.

Photoconductive Element B

Photoconductive Element B was a positively charging, multi-active photoconductive element not having a DLC layer and was prepared the same way and consisted of the same CGL and CTL as Photoconductive Element A, except that the CTL was coated onto the nickelized poly(ethylene terephthalate) first and then the CGL was coated over the CTL.

EXAMPLE 1

Photoconductive Element A Having a DLC Layer Produced From 100% Hexafluoroethane Reactant Gas A commercial parallel-plate plasma reactor (PlasmaTherm Model 730) was used for deposition of the fluorinated DLC layer onto Photoconductive Element A. The deposition chamber consisted of two 0.28 meter outer diameter electrodes, a grounded upper electrode and a powered lower electrode. The chamber walls were grounded, and the chamber is 0.38 meter in diameter. Removal of heat from the electrodes was accomplished via a fluid jacket. Four outlet ports (0.04 $m^3$), arranged 90° apart on a 0.33 meter-diameter circle on the lower wall of the reactor, lead the gases to a blower backed by a mechanical pump. A capacitance manometer monitored the chamber pressure that was controlled by an exhaust valve and controller. A 600-W generator delivered radio-frequency (RF) power at 13.56 MHz through an automatic matching network to the reactor. The gases used in the deposition flowed radially outward from the perforated upper electrode in a showerhead configuration in the chamber. The Photoconductive Element A to which the DLC layer was to be applied was adhered to the lower electrode for deposition using double-stick tape. The element was coated at room temperature. The fluorinated DLC layer was deposited on the charge transport layer of Photoconductive Element A.

The fluorinated DLC layer was deposited onto the photoconductor by introducing hexafluoroethane at a flow rate of 28.8 std. $cm^3$ into the reactor at a pressure of 12.9 Pa and an RF power of 100 W for 3 minutes.

Composition of the Outermost Surface Layer

The composition of the outermost surface layer of Example 1 was analyzed using x-ray photoelectron spectroscopy (XPS). The XPS spectra were obtained on a Physical Electronics 5601 photoelectron spectrometer with monochromatic A1 Kα x-rays (1486.6 eV). All spectra were referenced to the C 1s peak for neutral (aliphatic) carbon atoms, which was assigned a value of 284.6 eV. Peak-fitting to determine CF, $CF_2$ and $CF_3$ contents was done using a least-squares deconvolution routine employing line shapes with 90% Gaussian/10% Lorentzian character. Spectra were taken at a 45° electron takeoff angle (ETOA) which corresponds to an analysis depth of about 5 nm. Note that XPS is unable to detect hydrogen. The XPS results are presented in Table 1.

Latent Image Spread

Latent image spread (LIS) of the coated photoconductor was measured using the method described by D. S. Weiss, J. R. Chowdery, W. T. Ferrar, and R. H. Young, *Proceedings of IS&T's Eleventh International Congress on Advances in Non-Impact Printing Technologies* 1995, 57) at ambient conditions (45–48% relative humidity) and at elevated humidity (65–73% relative humidity) conditions.

The LIS measurement initially produces a square wave pattern in a plot of surface potential versus distance. For a photoconductive element experiencing LIS, as the image spreads, the comers of the square wave become rounded, and the width of the wave broadens. The width of the pattern is determined by drawing tangents to the sides of the wave and measuring the distance between the two tangents at the points where they intersect the baseline drawn between the unimaged portions of the wave. The width of the surface potential wave (image width) is measured as a function of time to determine LIS. The result corresponding to no latent image spread would be an invariant image width as a function of time. Lower image widths and no change in image width as a function of time or of humidity are the desired results. The results of this type of LIS measurement can be correlated with performance of the photoconductor in an electrophotographic imaging machine. Results of the LIS measurements for Example 1 appear in Tables 2 and 3.

Sensitivity Testing

Photoinduced discharge measurements (sensitivity testing) were performed to verify that the photoconductive element retained the required photosensitivity. This involved negatively charging the photoconductive element to 500 V in the dark, waiting for 2 seconds and measuring the change in the voltage to determine the rate of dark discharge, and then exposing the photoconductive element to 680 nm radiation, and monitoring the change in voltage as a function of time. The exposure energy (erg/$cm^2$) is defined as the energy required to discharge the photoconductor from 500 V to 100 V. The residual voltage is the final voltage on the photoconductive element. An increase of approximately 6% in residual voltage is expected when a coating is applied to a photoconductor due to reflection losses introduced by the DLC coating. The results are shown in Table 4.

Surface Energy

In order to measure the surface energy of the DLC layer of Example 1, the contact angles of the coating with water and with diiodomethane were measured. The average of 5 measurements was used for each liquid. The surface energy was calculated using these data and the method described by D. K. Owens and R. C. Wendt, *J. Appl. Polym. Sci.* 13, 1741 (1969). The surface energy of the DLC layer is reported in Table 5.

EXAMPLE 2

Photoconductive Element A Having a DLC Layer Produced From 90% Hexafluoroethane/10% Acetylene Reactant Gases with Argon The photoconductive element of this example was made according to the description in Example 1 except that the fluorinated DLC layer was deposited with the following gas types, and flow rates. Inert argon gas was introduced at a flow rate 30 of 12.8 std. $cm^3$, and the reactive gases acetylene and hexafluoroethane were introduced into the reaction chamber at flow rates of 3.2 std. $cm^3$ and 28.8 std. $cm^3$, respectively.

The surface composition, LIS measurements, sensitivity testing, and surface energy measurements for this example were determined as described in Example 1. The results appear in Tables 1–5.

EXAMPLE 3

Photoconductive Element A Having a DLC Layer Produced From 70% Hexafluoroethane/30% Acetylene Reactant Gases With Argon The photoconductive element of this example was made according to the description in Example 1 except that the fluorinated DLC layer was deposited with the following gas types, and flow rates. Inert argon gas was introduced at a flow rate of 38.4 std. $cm^3$, and the reactive gases acetylene and hexafluoroethane were introduced into the reaction chamber at flow rates of 9.6 std. $cm^3$ and 22.4 std. $cm^3$, respectively.

The surface composition, LIS measurements, sensitivity testing, and surface energy measurements for this example were determined as described in Example 1. The results appear in Tables 1–5.

EXAMPLE 4

Photoconductive Element A Having a DLC Layer Produced from 90% Hexafluoroethane/10% Acetylene Reactant Gases; No Non-reactive Gases The photoconductive element of this example was made according to the description in Example 1 except that the fluorinated DLC layer was deposited with the following gas types, and flow rates. The reactive gases acetylene and hexafluoroethane were introduced into the reaction chamber at flow rates of 3.2 std. $cm^3$ and 28.8 std. $cm^3$, respectively.

The surface composition, LIS measurements, and sensitivity testing for this example were determined as described in Example 1. The results appear in Tables 1–4.

EXAMPLE 5

Photoconductive Element A Having a DLC Layer Produced From 70% Hexafluoroethane/30% Acetylene Reactant Gases; No Non-reactive Gases The photoconductive element of this example was made according to the description in Example 1 except that the fluorinated DLC layer was deposited with the following gas types, and flow rates. The reactive gases acetylene and hexafluoroethane were introduced into the reaction chamber at flow rates of 9.6 std. $cm^3$ and 22.4 std. $cm^3$, respectively.

The surface composition, LIS measurements, and sensitivity testing for this example were determined as described in Example 1. The results appear in Tables 1–4.

EXAMPLE 6

Photoconductive Element A Having a DLC Layer Produced From 95% Hexafluoroethane/5% Butadiene Reactant Gases With Argon The photoconductive element of this example was made according to the description in Example 1 except that the fluorinated DLC layer was deposited with the following gas types and flow rates. Inert argon gas was introduced at a flow rate of 12.8 std. $cm^3$, and the reactive gases butadiene and hexafluoroethane were introduced into the reaction chamber at flow rates of 1.77 std. $cm^3$ and 28.8 std. $cm^3$, respectively.

The surface composition, LIS measurements, sensitivity testing and surface energy for this example were determined as described in Example 1. The results appear in Tables 1–5.

EXAMPLE 7

Photoconductive Element A Having a DLC Layer Produced From 90% Hexafluoroethane/10% Hydrogen Reactant Gases With Argon The photoconductive element of this example was made according to the description in Example 1 except that the fluorinated DLC layer was deposited with the following gas types and flow rates. Inert argon gas was introduced at a flow rate of 12.8 std. $cm^3$, and the reactive gases hydrogen and hexafluoroethane were introduced into the reaction chamber at flow rates of 3.2 std. $cm^3$ and 28.8 std. $cm^3$, respectively.

The surface composition, LIS measurements, and sensitivity testing for this example were determined as described in Example 1. The results appear in Tables 1–4.

EXAMPLES 8 AND 9

Photoconductive Element B Having a Fluorinated DLC Layer

The photoconductive elements of Examples 8 and 9 were prepared by coating Photoconductive Element B with the same DLC layers as described in Examples 2 and 3, respectively.

The surface compositions of the coatings of Examples 8 and 9 were determined by XPS, as described in Example 1. Results appear in Table 1. The materials of Examples 8 and 9 were evaluated by LIS and sensitivity testing except that the Photoconductive Elements of Examples 8 and 9 were positively charged to the same absolute values of the voltages used in Example 1. All displayed no measurable latent image spread at elevated humidity and no significant change in sensitivity testing results from the uncoated control.

COMPARATIVE EXAMPLE 1

Photoconductive Element A Having No DLC Layer

The surface composition, LIS, and sensitivity testing for Photoconductive Element A were measured as described in Example 1. The results appear in Tables 1–4.

COMPARATIVE EXAMPLE 2

Photoconductive Element A Having a Non-Fluorinated DLC Layer

Photoconductive Element A was coated as described in Example 1. This plasma-polymerized coating was composed of carbon, hydrogen, and oxygen only; no fluorine was present.

The surface composition, LIS measurements, and surface energy measurements for this example were determined as described in Example 1. The results appear in Tables 1–3, and 5.

COMPARATIVE EXAMPLE 3

Photoconductive Element A Having a DLC Layer Produced From 50% Hexafluoroethane/50% Acetylene Reactant Gases With Argon The photoconductive element of this example was made according to the description in Example 1 except that the DLC layer was deposited with the following gas types, flow rates and duration. Inert argon gas was introduced at a flow rate of 64 std. $cm^3$, and the reactive gases acetylene and hexafluoroethane were introduced into the reaction chamber at flow rates of 16 std. $cm^3$ and 16 std. $cm^3$, respectively. The deposition duration was 2 min.

The surface composition, sensitivity and surface energy of this Example were determined as described in Example 1. Results appear in Tables 1, 4, and 5.

LIS measurements were completed at elevated humidity as described in Example 1, except that the data collection speed was changed so that the width resolution was reduced. Differences of 0.2 mm LIS are not significant with this test method. The results appear in Table 3.

COMPARATIVE EXAMPLE 4

Photoconductive Element A Having a DLC Layer Produced From 25% Hexafluoroethane/75% Acetylene Reactant Gases With Argon The photoconductive element of this example was made according to the description in Example 1 except that the DLC layer was deposited with the following gas types, flow rates and duration. Inert argon gas was introduced at a flow rate of 96 std. $cm^3$, and the reactive gases acetylene and hexafluoroethane were introduced into the reaction chamber at flow rates of 24 std. $cm^3$ and 8 std. $cm^3$, respectively. The deposition duration was 2 minutes.

The surface composition, sensitivity and surface energy of this Example were determined as described in Example 1. Results appear in Tables 1, 4, and 5.

LIS measurements were completed at elevated humidity as described in Example 1, except that the data collection speed was changed so that the width resolution was reduced. Differences of 0.2 mm LIS are not significant with this test method. The results appear in Table 3.

COMPARATIVE EXAMPLE 5

Photoconductive Element A Having a DLC Layer Produced From 100% Acetylene Reactant Gas With Argon The photoconductive element of this example was made according to the description in Example 1 except that the DLC layer was deposited with the following gas types, flow rates and duration. Inert argon gas was introduced at a flow rate of 116 std. $cm^3$, and the reactive gas acetylene was introduced into the reaction chamber at a flow rate of 32 std. $cm^3$. The deposition duration was 2 minutes.

The surface composition, sensitivity and surface energy for this Example were determined as described in Example 1. Results appear in Tables 1, 4, and 5.

LIS measurements were completed at elevated humidity as described in Example 1, except that the data collection speed was changed so that the width resolution was reduced. Differences of 0.2 mm LIS are not significant with this test method. The results appear in Table 3.

COMPARATIVE EXAMPLES 6–8

Photoconductive Element B Having Non-Fluorinated DLC Layers

The photoconductive elements of Comparative Examples 6, 7, and 8 were prepared by coating Photoconductive Element B with the same DLC layers as described in Comparative Examples 3, 4, and 5, respectively.

The surface compositions of the coatings of Examples 6, 7, and 8 were determined as described in Example 1. The results appear in Table 1.

The materials of Comparative Examples 6–8 were evaluated by LIS and sensitivity testing except that these photoconductive elements were charged positively to the same absolute values of the voltages used in Example 1. All displayed no measurable latent image spread at elevated humidity and no significant change in sensitivity testing results from the uncoated control.

TABLE 1

COMPOSITION OF THE OUTERMOST SURFACE LAYER

| Example or Comparative Example | Elemental Composition | | | | Amount of carbon present as: | | |
|---|---|---|---|---|---|---|---|
| | Carbon (%) | Nitrogen (%) | Oxygen (%) | Fluorine (%) | CF (%) | $CF_2$ (%) | $CF_3$ (%) |
| Ex. 1 | 45.9 | 3.4 | 3.8 | 46.9 | 8.0 | 14.6 | 17.4 |
| Ex. 2 | 49.0 | 0.8 | 3.8 | 46.4 | 15.3 | 19.0 | 16.9 |
| Ex. 3 | 64.2 | 0.6 | 6.5 | 28.6 | 17.9 | 13.3 | 8.0 |
| Ex. 4 | 47.1 | 1.3 | 2.7 | 48.9 | 14.2 | 18.1 | 20.2 |
| Ex. 5 | 60.0 | 1.2 | 6.3 | 32.5 | 17.5 | 12.8 | 7.6 |
| Ex. 6 | 62.4 | 1.1 | 7.5 | 29.0 | 16.7 | 11.0 | 9.1 |
| Ex. 7 | 44.2 | 2.9 | 3.2 | 49.7 | 11.1 | 19.7 | 16.6 |
| Ex. 8 | 46.9 | 1.1 | 2.6 | 49.4 | N.D. | N.D. | N.D. |
| Ex. 9 | 57.6 | 1.0 | 5.1 | 36.3 | N.D. | N.D. | N.D. |
| Comp. Ex. 1 | 77.8 | 0.65 | 16.2 | 0 | 0 | 0 | 0 |
| Comp. Ex. 2 | 90.2 | N.D. | 9.7 | 0 | 0 | 0 | 0 |
| Comp. Ex. 3 | 71.1 | 0.8 | 9.2 | 18.3 | 5.9 | 10.7 | 3.6 |
| Comp. Ex. 4 | 80.2 | 0.6 | 9.4 | 9.7 | 11.0 | 5.2 | 2.1 |
| Comp. Ex. 5 | 87.7 | 0.6 | 11.0 | 0.4 | N.D. | N.D. | N.D. |
| Comp. Ex. 6 | 71.5 | 0.6 | 7.9 | 20.0 | N.D. | N.D. | N.D. |
| Comp. Ex. 7 | 81.2 | 0.5 | 9.9 | 8.4 | N.D. | N.D. | N.D. |
| Comp. Ex. 8 | 89.6 | 0.3 | 9.9 | 0.2 | N.D. | N.D. | N.D. |

N.D. = not determined

TABLE 2

LIS MEASURED AT AMBIENT CONDITIONS (45–48% RH)

| Time (sec) | Image width (mm) | | | | | | | | |
|---|---|---|---|---|---|---|---|---|---|
| | Ex. 1 | Ex. 2 | Ex. 3 | Ex. 4 | Ex. 5 | Ex. 6 | Ex. 7 | Comp. Ex. 1 | Comp. Ex. 2 |
| 0 | 3.28 | 3.29 | 3.31 | 3.33 | 3.30 | 3.28 | 3.24 | 3.35 | 3.30 |
| 60 | 3.30 | 3.31 | 3.30 | 3.31 | 3.30 | 3.33 | 3.30 | 3.35 | 3.36 |
| 150 | 3.30 | 3.28 | 3.26 | 3.33 | 3.29 | 3.30 | 3.28 | 3.34 | 3.41 |
| 300 | 3.31 | 3.31 | 3.30 | 3.30 | 3.30 | 3.30 | 3.28 | 3.35 | 3.50 |
| 600 | 3.29 | 3.28 | 3.30 | 3.34 | 3.28 | 3.33 | 3.28 | 3.35 | 3.52 |
| 1200 | 3.33 | 3.26 | 3.30 | 3.35 | 3.30 | 3.29 | 3.28 | 3.35 | 3.63 |
| 1800 | 3.29 | 3.28 | 3.28 | 3.31 | 3.29 | 3.29 | 3.29 | 3.35 | 3.68 |

TABLE 3

LIS MEASURED AT ELEVATED HUMIDITY (65–73% RH)

| Time (sec) | Image width (mm) | | | | | | | | | | | |
|---|---|---|---|---|---|---|---|---|---|---|---|---|
| | Ex. 1 | Ex. 2 | Ex. 3 | Ex. 4 | Ex. 5 | Ex. 6 | Ex. 7 | Comp Ex. 1 | Comp Ex. 2 | Ex. 8 | Ex. 9 | Ex. 10 |
| 0 | 3.25 | 3.25 | 3.29 | 3.29 | 3.28 | 3.30 | 3.28 | 3.44 | 3.30 | 3.3 | 3.56 | 3.43 |
| 60 | 3.30 | 3.30 | 3.31 | 3.31 | 3.31 | 3.30 | 3.29 | 3.48 | 3.38 | 3.3 | 3.43 | 3.43 |
| 150 | 3.28 | 3.25 | 3.28 | 3.31 | 3.28 | 3.33 | 3.30 | 3.45 | 3.43 | 3.3 | 3.43 | 3.43 |
| 300 | 3.30 | 3.28 | 3.30 | 3.31 | 3.30 | 3.30 | 3.31 | 3.48 | 3.57 | 3.3 | 3.56 | 3.43 |
| 600 | 3.28 | 3.28 | 3.28 | 3.30 | 3.30 | 3.33 | 3.29 | 3.52 | 3.58 | 3.3 | 3.43 | 3.56 |
| 1200 | 3.30 | 3.30 | 3.33 | 3.34 | 3.30 | 3.33 | 3.28 | 3.52 | 3.77 | 3.17 | 3.43 | 3.43 |
| 1800 | 3.28 | 3.28 | 3.30 | N.D. | 3.34 | 3.34 | 3.30 | N.D. | 3.89 | 3.3 | 3.56 | 3.56 |

N.D. = not determined

TABLE 4

SENSITIVITY TESTING RESULTS

| Example or Comparative Example | Change in dark voltage (V/sec) | Exposure energy (erg/cm$^2$) | Residual voltage (V) |
|---|---|---|---|
| Ex. 1 | 0 | 3.4 | 18 |
| Ex. 2 | 0 | 3.2 | 23 |
| Ex. 3 | 0 | 3.4 | 23 |
| Ex. 4 | 0 | 3.3 | 30 |
| Ex. 5 | 0 | 3.3 | 17 |
| Ex. 6 | 0 | 3.2 | 17 |
| Ex. 7 | 0 | 3.3 | 17 |
| Comp. Ex. 1 | 0 | 3.2 | 10 |
| Comp. Ex. 3 | 0 | 3.5 | 20 |
| Comp. Ex. 4 | 0 | 3.6 | 16 |
| Comp. Ex. 5 | 0 | 3.8 | 15 |

TABLE 5

SURFACE ENERGIES OF DLC LAYERS

| Example | Surface energy (mN/m) |
|---|---|
| Ex. 1 | 20 |
| Ex. 2 | 23 |
| Ex. 3 | 35 |
| Ex. 6 | 33 |
| Comp. Ex. 2 | 55 |
| Comp. Ex. 3 | 41 |
| Comp. Ex. 4 | 46 |
| Comp. Ex. 5 | 52 |

Comparison of the surface energy results obtained for the Examples to those obtained for the Comparative Examples demonstrates that the presence of fluorine at 25% or greater significantly lowers the surface energy of the coatings. The LIS and sensitivity testing results demonstrate that the lower surface energy is achieved without inducing latent image spread at room or elevated humidity conditions and without degrading the photosensitivity of the photoconductive members. The coatings containing 25% or greater fluorine do not change the required exposure energy compared to the uncoated sample, nor do they induce dark decay (change in dark voltage) or increase the residual voltage beyond acceptable levels.

The present invention has been described with reference to preferred embodiments thereof but it will be understood that various extensions and modifications can be effected within the spirit and scope of the invention.

What is claimed is:

1. An electrophotographic element comprising a conductive support, a charge generation layer, a charge transport layer comprising arylamine, and a diamond-like carbon layer having an outermost surface, wherein the fluorine content of said outermost surface of said diamond-like carbon layer is between 28.6 and 65 atomic percent based on the total composition of said outermost surface of said diamond-like carbon layer and wherein said outermost surface of said diamond-like carbon layer has a surface energy less than 40 mN/m.

2. An electrophotographic element according to claim 1 wherein said fluorine content is between 30 and 65 atomic percent.

3. An electrophotographic element according to claim 1 wherein the thickness of said diamond-like carbon layer is between about 0.05 and 0.5 micrometers.

4. An electrophotographic element according to claim 3 wherein the thickness of said diamond-like carbon layer is between about 0.15 and 0.2 micrometers.

5. An electrophotographic element according to claim 1 wherein said diamond-like carbon layer is a single layer.

6. An electrophotographic element according to claim 1 wherein said charge transport layer further comprises a polyester binder.

7. An electrophotographic element according to claim 1 wherein said outermost surface of said diamond-like carbon contains less than 20 atomic % oxygen, based on the total atomic composition of said outermost surface of said diamond-like carbon layer.

8. An electrophotographic element according to claim 1 wherein said charge generation layer is adjacent to said diamond-like carbon layer.

9. An electrophotographic element according to claim 1 wherein said charge transport layer is adjacent to said diamond-like carbon layer.

10. An electrophotographic element according to claim 1 wherein said charge generation layer comprises a charge generation material selected from the group consisting of dye polymer aggregates, phthalocyanines, squaraines, perylenes, azo-compounds, and trigonal selenium particles.

11. An electrophotographic element according to claim 1 wherein said charge generation layer comprises a dye polymer aggregate.

12. An electrophotographic element according to claim 1 wherein said arylamine is selected from the group consisting of triphenylamine; tri-p-tolylamine; N-N'-diphenyl-N,N'-bis-(3-methylphenyl)-(1,1'-biphenyl)-4,4'-diamine; 1,1-bis(di-4-tolylaminophenyl)cyclohexane; 4-(4-methoxystyryl)-4',4"-dimethoxytriphenylamine; N,N'-diphenyl-N,N'-di(m-tolyl)-p-benzidine, N,N',N",N'"-tetrakis(4-methylphenyl)-(1,1'-biphenyl)-4,4'-diamine; and mixtures of these materials.

13. An electrophotographic element according to claim 1 wherein said outermost surface of said diamond-like carbon layer has a surface energy less than 35 mN/m.

14. An electrophotographic element according to claim 1 wherein said outermost surface of said diamond-like carbon layer has a surface energy less than 25 mN/m.

15. A method of making an electrophotographic element comprising a conductive support, a charge generation layer, a charge transport layer, and a surface layer of diamond-like carbon, comprising the steps of:

a) providing an electrically conductive support;

b) solvent coating over said support, in any order, charge transport and charge generation layers, the charge transport layer comprising arylamine;

c) allowing the solvent to evaporate; and d) contacting the element formed in steps a), b), and c), in a reaction chamber, with a feed gas comprising a fluorocarbon compound in its gas phase and decomposing said compound by plasma-enhanced chemical vapor deposition to form a diamond-like carbon surface layer whose outermost surface has a fluorine content between 28.6 and 65 atomic percent based on the total composition of said outermost surface of said surface layer and wherein said outermost surface of said diamond-like carbon layer has a surface energy less than 40 mN/m.

16. A method according to claim 15 wherein said feed gas further comprises a gas or gaseous form of hydrogen or of a hydrocarbon compound.

17. A method according to claim 16 wherein said hydrocarbon compound is selected from the group consisting of paraffinic hydrocarbons represented by the formula $C_nH_{2n+2}$, where n is 1 to 10; olefinic hydrocarbons represented by formula $C_nH_{2n}$, where n is 2 to 10; acetylenic hydrocarbons represented by $C_nH_{2n-2}$, where n is 2 to 10; alicyclic hydrocarbons; aromatic compounds; and organic substituted compounds thereof.

18. A method according to claim 15 wherein said gas or gaseous form of fluorocarbon compound is selected from the group consisting of paraffinic fluorocarbons represented by the formula $C_nF_xH_y$, where n is 1 to 10, x+y=2n+2, and x is 3 to 2n+2; olefinic fluorocarbons represented by the formula $C_nF_xH_y$, where n is 2 to 10, x+y=2n, and x is 2 to 2n; acetylenic fluorocarbons represented by $C_nF_xH_y$, where n is 2 to 10, x+y=2n−2, and x is 1 to 2n−2; alkyl metal fluorides; aryl fluorides; alicyclic fluorides; styrene fluorides; fluorine-substituted silanes; fluorinated ketones; fluorinated aldehydes; and organic substituted compounds thereof.

19. The method of claim 15 wherein said charge generation layer is adjacent to said a diamond-like carbon layer.

20. The method of claim 15 wherein said charge transport layer is adjacent to said diamond-like carbon layer.

* * * * *